US012305647B2

(12) United States Patent
Akimoto et al.

(10) Patent No.: US 12,305,647 B2
(45) Date of Patent: May 20, 2025

(54) HERMETIC TYPE COMPRESSOR

(71) Applicant: FUJITSU GENERAL LIMITED, Kanagawa (JP)

(72) Inventors: Ryo Akimoto, Kanagawa (JP); Kenshi Ueda, Kanagawa (JP); Koji Ukai, Kanagawa (JP); Naoto Tada, Kanagawa (JP); Tatsuya Yasui, Kanagawa (JP); Yudai Morita, Kanagawa (JP)

(73) Assignee: FUJITSU GENERAL LIMITED, Kanagawa (JP)

( * ) Notice: Subject to any disclaimer, the term of this patent is extended or adjusted under 35 U.S.C. 154(b) by 0 days.

(21) Appl. No.: 18/291,684

(22) PCT Filed: Mar. 30, 2022

(86) PCT No.: PCT/JP2022/016289
§ 371 (c)(1),
(2) Date: Jan. 24, 2024

(87) PCT Pub. No.: WO2023/007864
PCT Pub. Date: Feb. 2, 2023

(65) Prior Publication Data

US 2025/0084846 A1 Mar. 13, 2025

(30) Foreign Application Priority Data

Jul. 26, 2021 (JP) ..... 2021-121732

(51) Int. Cl.
*F04C 29/04* (2006.01)
*F04C 2/344* (2006.01)

(52) U.S. Cl.
CPC ..... *F04C 29/04* (2013.01); *F04C 2/344* (2013.01); *F04C 2240/804* (2013.01)

(58) Field of Classification Search
CPC ..... F04C 29/04; F04C 2/344; F04C 2240/804
See application file for complete search history.

(56) References Cited

U.S. PATENT DOCUMENTS 6,213,732 B1 * 4/2001 Fujio ..... F04C 29/068 181/403
6,652,238 B2 * 11/2003 Kajiwara ..... F04C 29/045 417/44.11

(Continued)

FOREIGN PATENT DOCUMENTS

CN 202117925 U 1/2012
JP S60-095194 U 6/1985

(Continued)

*Primary Examiner* — Jesse S Bogue
(74) *Attorney, Agent, or Firm* — Paratus Law Group, PLLC

(57) ABSTRACT

A hermetic type compressor includes a compressor main body container that is a vertical type having a cylindrical shape, an accumulator container, a compression section that is arranged inside the compressor main body container, that compresses the refrigerant, sucked from the accumulator container, and that discharges the compressed refrigerant. The accumulator container includes an accumulator shell having a cup shape and a weld portion in which an opening side of the accumulator shell is bonded to the compressor main body container. A partition member, which partitions an interior portion of the accumulator shell, is provided in the interior portion, and a thermal insulation section, which blocks a heat transfer from the compressor main body container to the accumulator container, is formed between the partition member and a bottom shell, included in the compressor main body container. A thermal insulation member is provided in the thermal insulation section.

5 Claims, 4 Drawing Sheets

(56) References Cited

U.S. PATENT DOCUMENTS

| | | | | |
|---|---|---|---|---|
| 2012/0171064 | A1 | 7/2012 | Lee et al. | |
| 2023/0340904 | A1* | 10/2023 | Konno | F02B 39/14 |
| 2024/0271607 | A1* | 8/2024 | Yasui | F04C 29/12 |
| 2024/0309871 | A1* | 9/2024 | Ukai | F04C 29/12 |

FOREIGN PATENT DOCUMENTS

| | | | | |
|---|---|---|---|---|
| JP | H03-202682 | A | | 9/1991 |
| JP | H05-256275 | A | | 10/1993 |
| JP | H06-066258 | A | | 3/1994 |
| JP | 2000-310191 | A | | 11/2000 |
| JP | 2020-109283 | A | | 7/2020 |
| JP | 2020-139695 | A | | 9/2020 |
| JP | 2023133843 | A | * | 9/2023 |
| JP | 2024047411 | A | * | 4/2024 |

* cited by examiner

HERMETIC TYPE COMPRESSOR

CROSS REFERENCE TO PRIOR APPLICATION

This application is a National Stage Patent Application of PCT International Patent Application No. PCT/JP2022/016289 (filed on Mar. 30, 2022) under 35 U.S.C. § 371, which claims priority to Japanese Patent Application No. 2021-121732 (filed on Jul. 26, 2021), which are all hereby incorporated by reference in their entirety.

FIELD

The present invention relates to a hermetic type compressor that compresses and conveys a refrigerant in a refrigeration machine or an air conditioner operated by using a refrigeration cycle.

BACKGROUND

There is a known compressor, as a hermetic type compressor, that is constituted to have a structure in which a compression section and a motor that drives the compression section, are accommodated in an interior portion of a compressor main body container having a vertical cylindrical shape, and an accumulator container, which is used to separate a refrigerant into a gas refrigerant and a liquid refrigerant (hereinafter, sometimes referred to as "to separate a gas-liquid two-phase refrigerant") and which causes only the gas refrigerant to be sucked into a compression section, is provided at a lower part of the compressor main body container.

The compressor described in Patent Literature 1 is a compressor having a compression section with a rotary type. This compressor has a structure in which an accumulator container, which separates a gas-liquid two-phase refrigerant that is sucked into the compression section, is constituted by a container, which is formed independently of a compressor main body container, and is arranged below the compressor main body container, and the compressor main body container is connected to the accumulator container by using a bracket.

The compressor described in Patent Literature 2 is a compressor having a compression section with a scroll type. This compressor has a structure in which an accumulator container is directly bonded to a lower part of a compressor main body container, which accommodates a compression section and a motor that drives the compression section.

The compressor described in Patent Literature 3 has a structure in which an interior portion of an airtight container is divided by a pressure partition wall, an upper part of the pressure partition wall is used as a compressor main body container, in which a compression section and a motor are accommodated, and a lower part of the pressure partition wall is used as an accumulator container.

CITATION LIST

Patent Literature

Patent Literature 1: Japanese Laid-open Patent Publication No. 2020-109283

Patent Literature 2: Japanese Laid-open Patent Publication No. 3-202682

Patent Literature 3: Japanese Laid-open Patent Publication No. 6-66258

SUMMARY

Technical Problem

As described above related to Patent Literatures 1, 2, and 3, in the compressor in which the accumulator container is arranged in the lower part of the compressor main body container, in order to implement a highly reliable hermetic type compressor capable of reducing a manufacturing cost of the compressor and preventing a leakage of a refrigerant from the compressor main body container to the accumulator container, a structure, in which the accumulator container is welded to the compressor main body container, is conceived. However, if the accumulator container is welded to the compressor main body container, heat, which is generated at the interior portion of the compressor main body container, is likely to be conducted to the accumulator container, the refrigerant, which is contained in the accumulator container, may possibly be heated. As a result of the refrigerant contained in the accumulator container is heated, the temperature of the refrigerant, sucked from the accumulator container to the compressor main body container, rises, and the compression efficiency of the rotary compressor is decreased in accordance with the temperature rise.

Accordingly, the disclosed technology has been conceived in light of the circumstances described above, and an object thereof is to provide a hermetic type compressor capable of enhancing the thermal insulation property between the accumulator container, which is bonded to the compressor main body container, and the compressor main body container.

Solution to Problem

According to an aspect of an embodiments in the present application, a hermetic type compressor includes: a compressor main body container that is a vertical type having a cylindrical shape and that is provided with a discharge pipe and a suction pipe for a refrigerant; an accumulator container that is connected to the suction pipe; a compression section that is arranged inside the compressor main body container, that compresses the refrigerant, which has been sucked from the accumulator container by way of the suction pipe, and that discharges the compressed refrigerant from the discharge pipe; and a motor that is arranged inside the compressor main body container and that drives the compression section, wherein the accumulator container includes an accumulator shell having a cup shape, and a weld portion in which an opening side of the accumulator shell is bonded to the compressor main body container, a partition member, which partitions an interior portion of the accumulator shell, is provided in the interior portion, a thermal insulation section, which blocks a heat transfer from the compressor main body container to the accumulator container, is formed between the partition member and a bottom shell, which is included in the compressor main body container, and a thermal insulation member is provided in the thermal insulation section.

Advantageous Effects of Invention

According to an aspect of an embodiment of a hermetic type compressor disclosed in the present application, it is possible to enhance a thermal insulation property between an accumulator container, which is bonded to a compressor main body container, and the compressor main body container.

DESCRIPTION OF EMBODIMENTS

Preferred embodiments of a hermetic type compressor, disclosed in the present invention, will be described in detail below with reference to the accompanying drawings. Furthermore, the hermetic type compressor, disclosed in the present invention, is not limited by the embodiments described below.

Embodiment (Configuration of Rotary Compressor)

Figure 1:
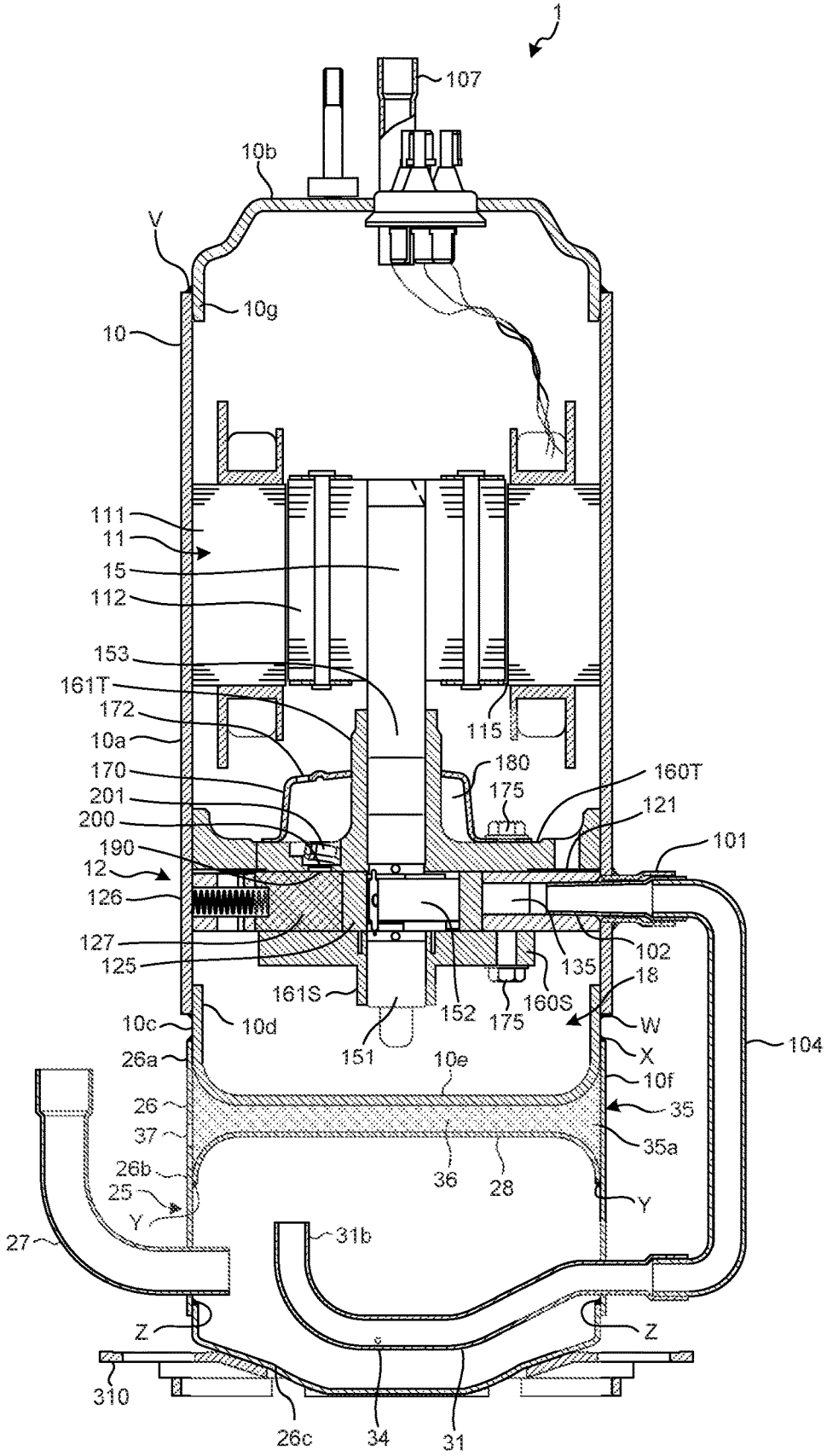
FIG. 1 is a longitudinal sectional diagram illustrating a rotary compressor according to an embodiment.
Figure 2:
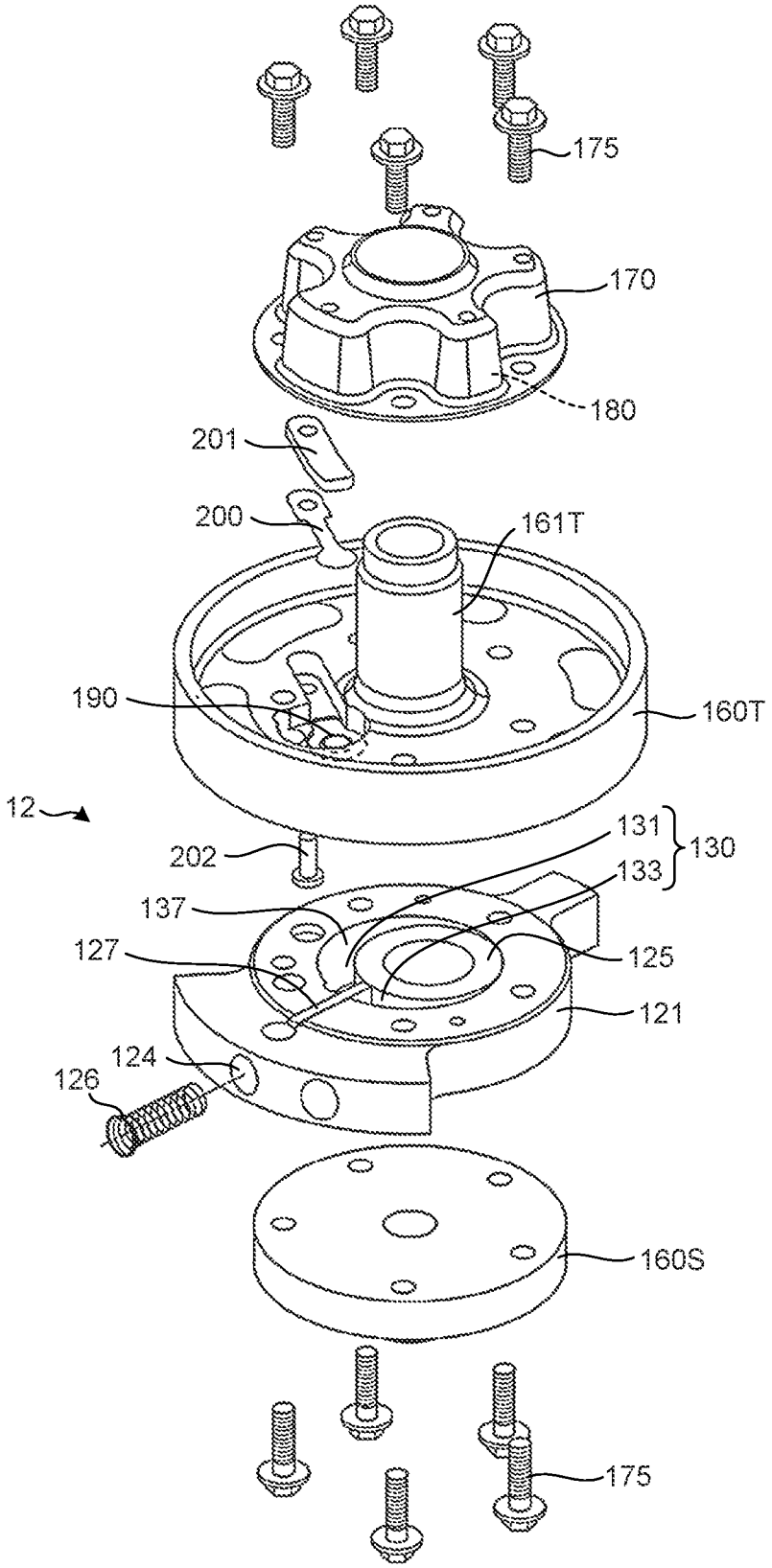
FIG. 2 is an exploded perspective diagram illustrating a compression section of the rotary compressor according to the embodiment.

In the present embodiment, a rotary compressor will be described as one example of the compressor. FIG. 1 is a longitudinal sectional diagram illustrating a rotary compressor according to an embodiment. FIG. 2 is an exploded perspective diagram illustrating a compression section of the rotary compressor according to the embodiment.

As illustrated in FIG. 1, a rotary compressor 1 is a hermetic type compressor with an internal high pressure type, which is constituted to have a structure in which a compression section 12 that sucks a refrigerant from a compression section suction pipe 102, that compresses the sucked refrigerant, and that discharges the compressed refrigerant to the interior portion of a compressor main body container 10, and a motor 11 that drives the compression section 12, are accommodated in an interior portion of the compressor main body container 10, and a high pressure refrigerant, which has been compressed by the compression section 12, is discharged to the interior portion of the compressor main body container 10, and is further discharged to a refrigeration cycle through a discharge pipe 107.

The compressor main body container 10 includes a main shell 10*a* having a vertical cylindrical shape, a top shell 10*b* having a cup shape, and a bottom shell 10*c* having a cup shape, and is constituted to have a structure, in which an opening side 10*g* of the top shell 10*b* is secured to an upper end portion of the main shell 10*a* at a first weld portion V by performing a welding process, and an opening side 10*d* of the bottom shell 10*c* is secured to a lower end portion of the main shell 10*a* at a second weld portion W by performing a welding process.

The compression section suction pipe 102, which is used to suck a low pressure refrigerant in a refrigeration cycle into the compression section 12, is provided by passing through the main shell 10*a*. Specifically, a guide tube 101 is secured to the main shell 10*a* by being subjected to brazing, and the compression section suction pipe 102 passes through an inner side of the guide tube 101 and is secured to the guide tube 101 by being subjected to brazing.

The discharge pipe 107 that is used to discharge a high pressure refrigerant, which has been compressed by the compression section 12, from the interior portion of the compressor main body container 10 to the refrigeration cycle, is provided by passing through the top shell 10*b*. The discharge pipe 107 is directly secured to the top shell 10*b* by being subjected to brazing.

An accumulator container 25 that is used to suck, into the compression section 12, only a gas refrigerant that is obtained by separating a low pressure gas-liquid two-phase refrigerant, which is sucked from the refrigeration cycle, is provided below the compressor main body container 10. Specifically, the accumulator container 25 is formed by securing an opening side 26*a* of an accumulator shell 26 to an opposite opening side 10*e* of the bottom shell 10*c* at a third weld portion X by performing a welding process and hermetically sealing the interior portion of the accumulator shell 26, at a position lower than the second weld portion W between the main shell 10*a* and the bottom shell 10*c*, included in the compressor main body container 10.

In the accumulator shell 26, each of an accumulator suction pipe 27, which is used to suck a refrigerant into the interior portion of the accumulator container 25 from the refrigeration cycle, and a gas-liquid separation tube 31, which is used to convey a gas refrigerant from the interior portion of the accumulator passes through the accumulator shell 26, is secured to the accumulator shell 26 by being subjected to brazing.

The gas-liquid separation tube 31 is connected to the compression section suction pipe 102 on the outside of the accumulator container 25 via a suction pipe 104.

A base member 310, which supports the entirety of the compressor, is welded and secured to the lower part of the accumulator shell 26.

The compression section 12 includes a cylinder 121, an upper end plate 160T, a lower end plate 160S, and a rotation shaft 15, and the upper end plate 160T, the cylinder 121, and the lower end plate 160S are laminated in this order, and are secured by a plurality of bolts 175. The upper end plate 160T is provided with a main bearing portion 161T. The lower end plate 160S is provided with a secondary bearing portion 161S. The rotation shaft 15 is provided with a main shaft portion 153, an eccentric portion 152, and a secondary shaft portion 151. The main shaft portion 153, which is provided in the rotation shaft 15, is fitted into the main bearing portion 161T, which is provided in the upper end plate 160T, and the secondary shaft portion 151, which is provided in the rotation shaft 15, is fitted into the secondary bearing portion 161S, which is provided in the lower end plate 160S, so that the rotation shaft 15 is rotatably supported.

The motor 11 includes a stator 111 that is arranged on an outer side, and a rotor 112 that is arranged on an inner side. The stator 111 is secured to the inner circumferential surface of the main shell 10*a* by using a shrink fit process. The rotor 112 is secured to the rotation shaft 15 by using a shrink fit process.

In the interior portion of the compressor main body container 10, in order to lubricate a sliding member of the compression section 12, and seal a high pressure section and a low pressure section that are included in a compression chamber, lubricating oil 18 with an amount, which is enough to substantially immerse the compression section 12, is enclosed.

In the following, the compression section 12 will be described in detail with reference to FIG. 2.

A hollow portion 130 having a cylindrical shape is provided in the interior portion of the cylinder 121, and a piston 125 is arranged at the hollow portion 130. The piston 125 is fitted into the eccentric portion 152, which is provided in the rotation shaft 15. The cylinder 121 is provided with a groove portion that is outwardly provided from the hollow portion 130, and a vane 127 is arranged at the groove portion. The cylinder 121 is provided with a spring hole 124 leading from the outer circumference to the groove portion, and a spring 126 is arranged in the spring hole 124. As a result of one end of the vane 127 being pressed against the piston 125 by the spring 126, an outer space of the piston 125 is divided into a suction chamber 133 and a discharge chamber 131 at the hollow portion 130 of the cylinder 121. The cylinder 121 is provided with a suction hole 135 that communicates from the outer circumference to the suction chamber 133. The compression section suction pipe 102 is connected to the suction hole 135. The upper end plate 160T is provided with a discharge hole 190, which passes through the upper end plate 160T and communicates with the discharge chamber 131. On the upper end plate 160T, a discharge valve 200, which opens and closes the discharge hole 190, and a discharge valve holder 201, which prevents warpage of the discharge valve 200, are secured by a rivet 202. On the upper side of the upper end plate 160T, an upper end plate cover 170, which covers the discharge hole 190, is arranged, so that an upper end plate cover chamber 180, which is blocked by the upper end plate 160T and the upper end plate cover 170, is formed. The upper end plate cover 170 is secured to the upper end plate 160T by the plurality of bolts 175, each of which secures the upper end plate 160T and the cylinder 121. The upper end plate cover 170 is provided with an upper end plate cover discharge hole 172, which communicates between the upper end plate cover chamber 180 and the interior portion of the compressor main body container 10.

In the following, a flow of a refrigerant, which is sucked in by a rotation of the rotation shaft 15, will be described.

The piston 125, which is fitted into the eccentric portion 152 provided in the rotation shaft 15, performs an orbital motion caused by a rotation of the rotation shaft 15, so that the suction chamber 133 sucks a refrigerant while increasing its volume. As a suction path of the refrigerant, a low pressure refrigerant in the refrigeration cycle is sucked into the interior portion of the accumulator container 25 by way of the accumulator suction pipe 27, and, in the case where a liquid is mixed with the refrigerant, which has been sucked into the accumulator container 25, the refrigerant is retained in a lower part of the accumulator container 25, and only the gas refrigerant is sucked into the gas-liquid separation tube 31, which is upwardly opened in the interior portion of the accumulator container 25. The gas refrigerant, sucked into the gas-liquid separation tube 31, is sucked into the suction chamber 133 after passing through the suction pipe 104 and the compression section suction pipe 102. If a large amount of the liquid refrigerant is contained in the refrigerant, which is to be sucked from the refrigeration cycle, the liquid level of the liquid refrigerant becomes higher than the position of an open end 31*b* of the gas-liquid separation tube 31 in the interior portion of the accumulator container 25, and the large amount of liquid refrigerant may possibly flow into the gas-liquid separation tube 31. If the large amount of liquid refrigerant flows into the compression section 12 through the gas-liquid separation tube 31, this causes damage to the compression section 12. In order to prevent a large amount of liquid refrigerant from flowing into the gas-liquid separation tube 31, the gas-liquid separation tube 31 is provided with a liquid return hole 34, which is used to suck a liquid refrigerant into the gas-liquid separation tube 31 little by little.

In the following, a flow of a refrigerant, which is discharged by a rotation of the rotation shaft 15, will be described.

The piston 125, which is fitted into the eccentric portion 152 provided in the rotation shaft 15, performs an orbital motion caused by a rotation of the rotation shaft 15, so that the discharge chamber 131 compresses the refrigerant while contracting its volume, and, if a pressure of the compressed refrigerant is higher than a pressure of the upper end plate cover chamber 180 disposed on the outer side of the discharge valve 200, the discharge valve 200 is opened, and then, the refrigerant is discharged from the discharge chamber 131 to the upper end plate cover chamber 180. The refrigerant, discharged to the upper end plate cover chamber 180, is discharged into the compressor main body container 10 from the upper end plate cover discharge hole 172, which is provided in the upper end plate cover 170.

The refrigerant, which has been discharged into the compressor main body container 10, is guided to an upper part of the motor 11 after passing through a notch (not illustrated) that is provided around the outer circumference of the stator 111 and that communicates between an upper and lower portions of the motor 11, or passing through a gap with a winding portion of the stator 111 (not illustrated) or a gap 115 between the stator 111 and the rotor 112 (see FIG. 1), and is discharged to the refrigeration cycle from the discharge pipe 107 that is provided in the top shell 10*b*.

In the following, a flow of the lubricating oil 18 will be described.

The lubricating oil 18, which is enclosed in the lower part of the compressor main body container 10, is supplied to the compression section 12 after passing through the interior portion (not illustrated) of the rotation shaft 15 by a centrifugal force generated by the rotation shaft 15. The lubricating oil 18, which is supplied to the compression section 12, is mixed with the refrigerant, is turned into a mist state, and is drained into the interior portion of the compressor main body container 10 together with the refrigerant. The lubricating oil 18, which has been turned into a mist state and drained into the interior portion of the compressor main body container 10, is separated from the refrigerant by the centrifugal force of a rotational force generated by the motor 11, and returns to the lower part of the compressor main body container 10 again in the form of oil drops. However, some of the lubricating oil 18 is not separated and is drained into the refrigeration cycle together with the refrigerant. The lubricating oil 18, which has been drained into the refrigeration cycle, returns to the accumulator container 25 after circulating the refrigeration cycle, is separated at the interior portion of the accumulator container 25, and is retained in the lower part inside the accumulator container 25. The lubricating oil 18, which is retained in the lower part inside the accumulator container 25, flows into the gas-liquid separation tube 31 little by little after passing through the liquid return hole 34 together with the liquid refrigerant, and is sucked into the suction chamber 133 together with the sucked refrigerant.

(Characteristic Configuration of Rotary Compressor)

In the following, a characteristic configuration of the rotary compressor 1 according to the embodiment, will be described. The characteristic feature of the present embodiment is that, as illustrated in FIG. 1, a thermal insulation member 36 is provided in the interior portion of the accumulator container 25.

(Structure of Thermal Insulation Section)

Figure 3:
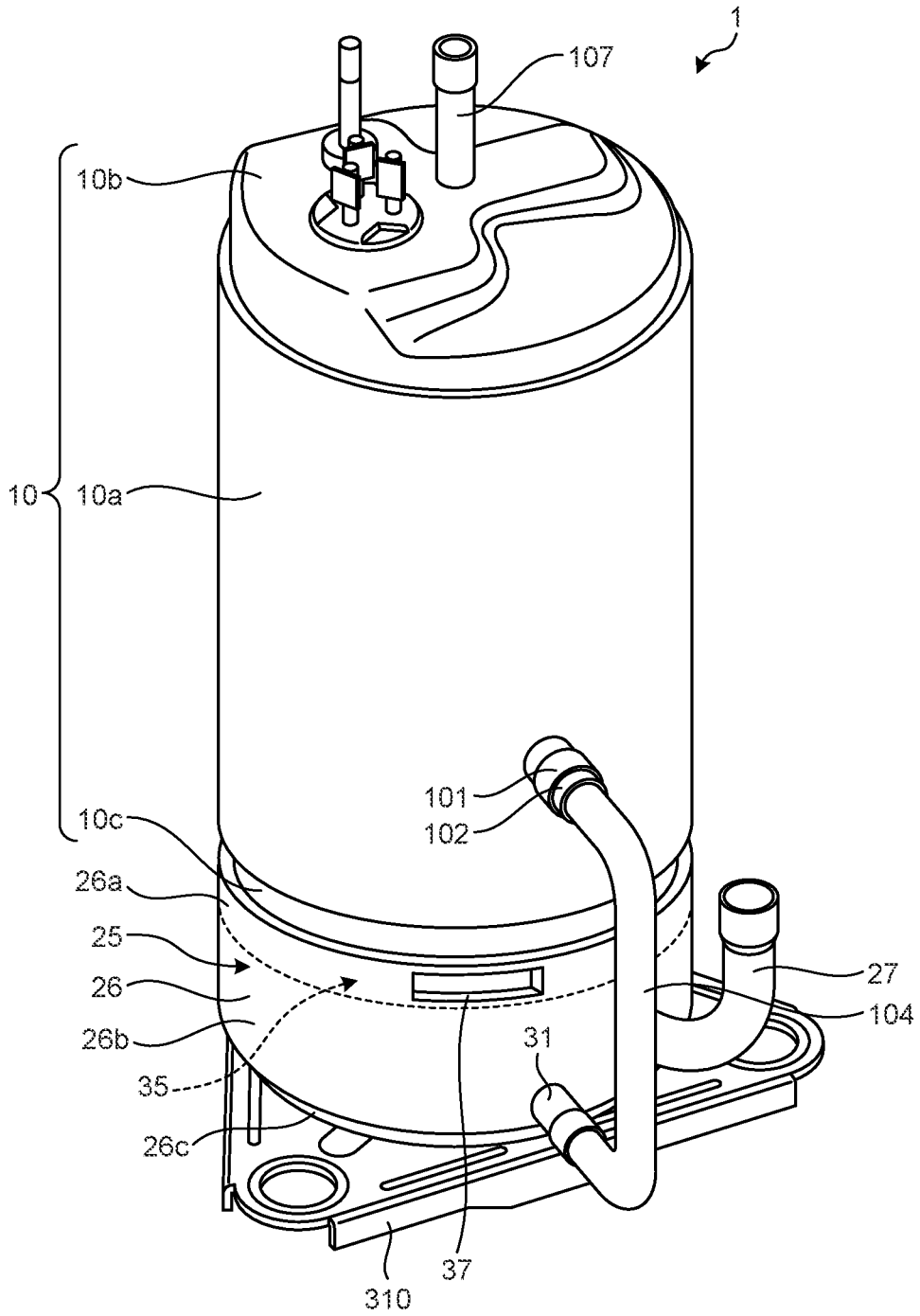
FIG. 3 is a perspective diagram illustrating the rotary compressor according to the embodiment.

FIG. 3 is a perspective diagram illustrating the rotary compressor 1 according to the embodiment. As illustrated in FIG. 1 and FIG. 3, in the interior portion of the accumulator shell 26 included in the accumulator container 25, a partition member 28, which partitions the interior portion, is provided, and, a thermal insulation section 35, which blocks a heat transfer from the compressor main body container 10 to the accumulator shell 26, is formed between the partition member 28 and the bottom shell 10*c* of the compressor main body container 10. The thermal insulation section 35 is provided with the thermal insulation member 36. As a result of this, it is possible to suppress a refrigerant, contained in the accumulator shell 26, from being heated by heat, which is generated in the interior portion of the compressor main body container 10. The thermal insulation section 35 includes an interior portion space 35*a*, in which the thermal insulation member 36 is provided, and a through hole 37, which is provided by passing through the accumulator shell 26 and which is used to insert the thermal insulation member 36 into the interior portion space 35*a*. Furthermore, coating is applied on the inner surface of the interior portion space 35*a* in which the thermal insulation member 36 is provided, and prevents rust from being formed caused by dew condensation occurring in the interior portion space 35*a*.

The thermal insulation member 36 used may be, for example, a foamable thermal insulation material, such as a polystyrene foam, glass wool, or the like. The structure of the thermal insulation section 35, provided with the thermal insulation member 36, is not limited to the structure, in which the thermal insulation member 36 is filled in the entirety of the interior portion space 35*a*, but may include a structure, in which the thermal insulation member 36 is arranged so as to include an air layer corresponding to a hollow state in a part of the interior portion space 35*a*. The structure of the thermal insulation member 36, which is provided at a position adjacent to the bottom shell 10*c* provided in the compressor main body container 10, is not limited to the structure, in which the thermal insulation member 36 is arranged to be brought into contact with the bottom shell 10*c*, but may include a structure, in which the thermal insulation member 36 is arranged so as to sandwich the air layer with the bottom shell 10*c*. Furthermore, the thermal insulation member 36 may be formed a plurality of types of thermal insulation members, which are laminated in the vertical direction of the accumulator container 25, or, for example, may be formed by using a particulate thermal insulation member and a foamable thermal insulation member in combination.

As described above, the accumulator container 25 includes the third weld portion X, in which the accumulator shell 26 is bonded to the bottom shell 10*c* of the compressor main body container 10. The accumulator shell 26 according to the present embodiment includes a main shell 26*b* that has a cylindrical shape and that includes the opening side 26*a* corresponding to the upper end portion, a bottom shell 26*c* that has a cone shape and that is bonded so as to block the lower end portion of the main shell 26*b*, and the partition member 28 that is provided on the inner side of the main shell 26*b* and that forms the interior portion space 35*a* of the thermal insulation section 35.

The outer circumference portion of the partition member 28 is bent toward the lower part of the accumulator shell 26. The outer circumference surface of the bent outer circumference portion of the partition member 28 is bonded to the inner circumferential surface of the main shell 26*b* at the fourth weld portion Y. The inner circumferential surface of the main shell 26*b* is bonded to the outer circumference surface of the bottom shell 26*c* at the fifth weld portion Z. Furthermore, each of the third weld portion X, the fourth weld portion Y, and the fifth weld portion Z of the accumulator shell 26 is formed along the circumferential direction of the accumulator shell 26. Therefore, introduction space, to which the refrigerant is introduced in the interior portion of the accumulator shell 26, is hermetically sealed by the main shell 26*b*, the bottom shell 26*c*, and the partition member 28. Furthermore, the interior portion space 35*a* included in the thermal insulation section 35 is formed by the opening side 26*a* of the accumulator shell 26, the bottom shell 10*c* provided in the compressor main body container 10, and the partition member 28. The shape of the outer circumference portion of the partition member 28 is not limited to the shape that is bent toward the lower part of the accumulator shell 26, but may have a shape that is bent toward the upper portion of the accumulator shell 26, as in also the case of the shape of the bottom shell 10*c* of the compressor main body container 10.

In the process of manufacturing the rotary compressor 1 according to the present embodiment, after the accumulator shell 26, to which the partition member 28 is bonded at the fourth weld portion Y, is bonded to the bottom shell 10*c* of the compressor main body container 10 at the third weld portion X, coating is applied on the inner surface of the interior portion space 35*a* of the thermal insulation section 35. After the coating has been applied, the thermal insulation member 36 is filled in the interior portion space 35*a* included in the thermal insulation section 35 by way of the through hole 37.

In the embodiment, a single piece of the through hole 37 having a slit shape is provided, but the shape and the number of through holes 37 are not limited. In the present embodiment, for example, a nozzle of an injector for injecting a foamable thermal insulation material is inserted into the through hole 37, and then, the thermal insulation member 36 is filled into the interior portion space 35*a* included in the thermal insulation section 35 by way of the through hole 37. The through hole 37 is blocked by the thermal insulation member 36 that has been filled in the interior portion space 35*a* included in the thermal insulation section 35. Furthermore, after the thermal insulation member 36 has been filled in the thermal insulation section 35 by way of passing through the through hole 37, the through hole 37 may be closed by fitting, for example, a sealing plug (not illustrated), or the like into the through hole 37.

Furthermore, the through hole 37 described above is provided at a position between the bottom shell 10*c* of the compressor main body container 10 and the partition member 28 in the vertical direction of the accumulator container 25, but the position of the through hole 37 is not limited to this. Although not illustrated, the through hole 37 may also be arranged in a lower part inside the interior portion space 35*a* of the thermal insulation section 35, or may be arranged in the vicinity of, for example, the fourth weld portion Y in which the partition member 28 is bonded to the inner circumferential surface of the main shell 26*b*.

The coating, applied to the inner surface of the interior portion space 35*a* included in the thermal insulation section 35, may be applied by, for example, electrodeposition coating. In a case of the electrodeposition coating, the accumulator container 25, which is a coated object, is immersed in a tank, in which a water-soluble coating is dissolved, a coated film is formed on the inner surface of the interior portion space 35*a* included in the thermal insulation section 35 provided in the accumulator container 25 by sending electricity between an electrode and the accumulator container 25. In the case of the electrodeposition coating, it is possible to easily drain the water-soluble coating entering from the through hole 37 into the interior portion space 35*a* from the through hole 37.

Effects of Embodiment

As described above, in the rotary compressor 1 according to the embodiment, the accumulator container 25 includes the accumulator shell 26 that has a cup shape in which the opening side 26*a* is opened, and the third weld portion X in which the opening side 26*a* of the accumulator shell 26 is bonded to the compressor main body container 10. The partition member 28, which partitions the interior portion of the accumulator shell 26, is provided in the interior portion; the thermal insulation section 35, which blocks a heat transfer from the compressor main body container 10 to the accumulator container 25, is formed between the partition member 28 and the bottom shell 10*c* of the compressor main body container 10; and the thermal insulation section 35 includes the interior portion space 35*a*, in which the thermal insulation member 36 is provided, and the through hole 37, which is provided by passing through the accumulator shell 26 and which is used to insert the thermal insulation member 36 into the interior portion space 35*a*. The thermal insulation section 35 is provided with the thermal insulation member 36. As a result of this, after the opening side 26*a* of the accumulator shell 26 and the compressor main body container 10 have been welded, it is possible to insert the thermal insulation member 36 into the interior portion space 35*a* of the thermal insulation section 35 by way of the through hole 37, and it is thus possible to enhance the thermal insulation property between the accumulator container 25, which is bonded to the compressor main body container 10, and the compressor main body container 10. In other words, even in the case of the structure in which the opening side 26*a* of the accumulator shell 26 is bonded to the compressor main body container 10, it is possible to suppress the heat, generated at the interior portion of the compressor main body container 10, from being conducted to the accumulator container 25 by the thermal insulation member 36, and it is thus possible to suppress the refrigerant, contained in the accumulator container 25, from being heated. Therefore, it is possible to prevent a decrease in the compression efficiency of the rotary compressor 1 in accordance with a temperature rise in the refrigerant, which is sucked from the accumulator container 25 to the compressor main body container 10.

Furthermore, the thermal insulation section 35 included in the rotary compressor 1 according to the embodiment includes the through hole 37, which is provided by passing through the accumulator shell 26 and which is used to insert the thermal insulation member 36 into the interior portion space 35*a* of the thermal insulation section 35, and coating is applied on the inner surface of the thermal insulation section 35. As a result of this, after the opening side 26*a* of the accumulator shell 26 and the compressor main body container 10 have been welded, it is possible to insert the thermal insulation member 36 into the interior portion space 35*a* provided in the thermal insulation section 35 by way of the through hole 37.

Furthermore, the rotary compressor 1 according to the embodiment is constituted to have a structure, in which the bottom shell 10*c* of the compressor main body container 10 is arranged by being inserted into the opening of the opening side 26*a* of the accumulator shell 26, and the opening side 26*a* of the accumulator shell 26 is bonded to the bottom shell 10*c* of the compressor main body container 10 by the third weld portion X. As a result of this, it is possible to easily apply the rotary compressor 1 by using the existing compressor main body container 10 and inserting the bottom shell 10*c* provided in the compressor main body container 10 into the opening of the opening side 26*a* of the accumulator shell 26, and also, it is possible to suppress an increase in the manufacturing cost by eliminating an attachment member, such as an attachment band, that is used to attach the accumulator container 25 to the compressor main body container 10. Furthermore, it is possible to avoid noise and vibration caused by the natural vibration frequency of another member as compared to the structure in which the accumulator shell 26 is indirectly coupled to the bottom shell 10*c* that is provided in the compressor main body container 10 by way of the other member.

Furthermore, in the rotary compressor 1 according to the embodiment, the through hole 37, disposed in the accumulator shell 26, is arranged in the lower part of the interior portion space 35*a* provided in the thermal insulation section 35. As a result of this, for example, in the case where the coating for preventing rust from being formed on the inner surface of the interior portion space 35*a* is applied by using the electrodeposition coating technique, it is possible to form the coated film on the inner surface of the interior portion space 35*a* provided in the thermal insulation section 35 disposed in the accumulator container 25 by immersing the accumulator container 25 in the tank, in which a water-soluble coating is dissolved, and sending electricity between the electrode and the accumulator container 25. Furthermore, in a case of the electrodeposition coating, it is possible to easily drain the water-soluble coating, entering from the through hole 37 into the interior portion space 35*a*, from the through hole 37.

Furthermore, in the rotary compressor 1 according to the embodiment, the accumulator shell 26 includes the main shell 26*b* that has a cylindrical shape and that includes the opening side 26*a*, the bottom shell 26*c* that is bonded so as to block the lower end portion of the main shell 26*b*, and the partition member 28 that is provided on the inner side of the main shell 26*b* and that forms the interior portion space 35*a* provided in the thermal insulation section 35. As a result of this, it is possible to appropriately form, in the interior portion of the accumulator shell 26, the thermal insulation section 35, which has the interior portion space 35*a* and in which the thermal insulation member 36 is provided.

In the present disclosure, the structure of the opening side 26*a* of the accumulator shell 26 is not limited to the structure, in which the opening side 26*a* is bonded to the bottom shell 10*c* that is provided in the compressor main body container 10. Although not illustrated, the opening side 26*a* of the accumulator shell 26 may be bonded to the main shell 10*a* that is provided in the compressor main body container 10. Furthermore, the outer circumference portion of the partition member 28, which forms the thermal insulation section 35, may be bent to an upward direction of the accumulator shell 26, and bonded to the outer circumference surface of the opening side 10*d* of the bottom shell 10*c*, provided in the compressor main body container 10. In this case, the opening side 26*a* of the accumulator shell 26 is bonded to the outer circumference portion of the partition member 28, and is indirectly bonded to the bottom shell 10*c* provided in the compressor main body container 10 by way of the partition member 28. In this way, in the present disclosure, the structure, in which the opening side 26*a* of the accumulator shell 26 is bonded to the compressor main body container 10, includes the structure, in which the opening side 26*a* of the accumulator shell 26 is bonded to the bottom shell 10*c* provided in the compressor main body container 10 by way of the partition member 28. Furthermore, even in the case of the configuration described above, by arranging the through hole 37 at the upper part of the interior portion space 35*a* that is provided in the thermal insulation section 35, and, by applying the coating in a state, in which the vertical direction of the compressor main body container 10 and the accumulator container 25 is disposed in the opposite direction at the time of a process of manufacturing the rotary compressor 1, it is possible to easily drain the water-soluble coating, which has entered from the through hole 37 into the interior portion space 35*a*, from the through hole 37.

In addition, in the present embodiment, the opening side 26*a* of the accumulator shell 26 is bonded to the bottom shell 10*c* that is provided in the compressor main body container 10, but, for example, a ring shaped accumulator shell may be arranged along the circumferential direction of the outer circumference surface of the main shell 10*a* that is provided in the compressor main body container 10. Furthermore, the accumulator shell 26 having a cylindrical shape may be bonded to the top shell 10*b* provided in the compressor main body container 10. Also in this case, it is possible to obtain the same effect as that in the present embodiment by arranging, in the interior portion of the accumulator shell 26, the thermal insulation member 36 at the position adjacent to the main shell 10*a* provided in the compressor main body container 10.

In the following, a modification will be described with reference to drawings. In the modification, components having the same configuration as those described in the embodiment are assigned the same reference numerals as those assigned in the embodiment, and descriptions thereof will be omitted. It is possible to obtain the same effect at that obtained by the through hole 37 according to the embodiment by forming a notch portion 39 at a part of the circumferential direction of the opening side 26*a* of the accumulator shell 26 according to the embodiment.

(Modification)

Figure 4:
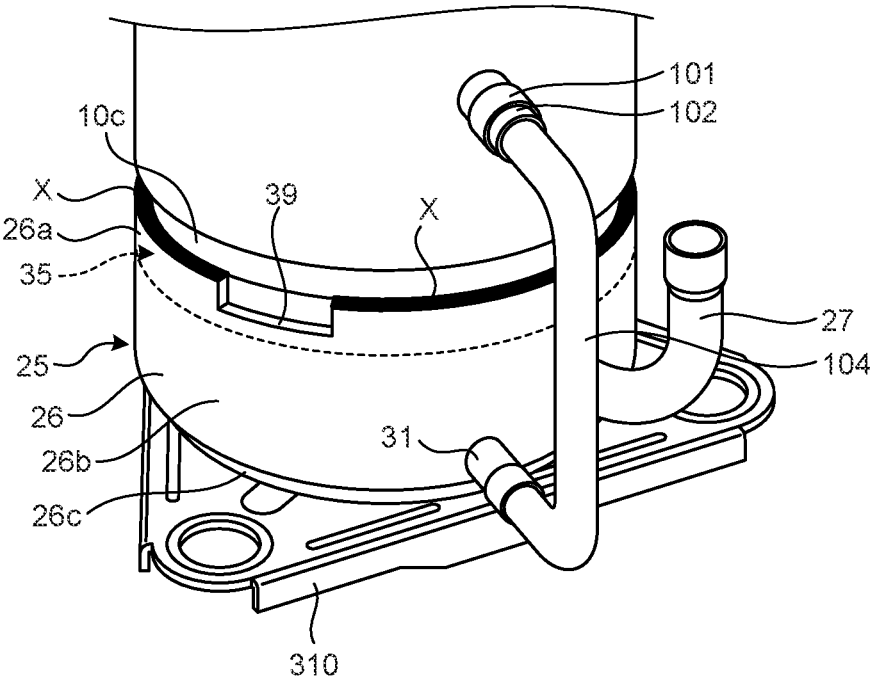
FIG. 4 is a perspective diagram illustrating a relevant part in a modification.

FIG. 4 is a perspective diagram illustrating a relevant part according to the modification. As illustrated in FIG. 4, in the modification, the notch portion 39 is formed in a part of the circumferential direction of the end portion of the opening side 26*a* of the accumulator shell 26. The opening side 26*a* of the accumulator shell 26 is bonded by the third weld portion X along the circumferential direction of the opening side 26*a* except for the notch portion 39. With such a structure, also, it is possible to insert the thermal insulation member 36 into the interior portion space 35*a*, which is provided in the thermal insulation section 35, by way of the notch portion 39 that is open by passing through the accumulator shell 26.

According to the modification, similarly to the embodiment, the opening side 26*a* of the accumulator shell 26 and the compressor main body container 10 are welded, and, subsequently, after the coating has been applied on the inner surface of the thermal insulation section 35, the thermal insulation member 36 is inserted into the interior portion space 35*a*, provided in the thermal insulation section 35, by way of the notch portion 39.

In addition, the rotary compressor according to the present embodiment is not limited to a rotary compressor having a single cylinder, i.e., what is called a single-cylinder-type rotary compressor, but may be applied to a rotary compressor having two cylinders, i.e., what is called a two-cylinder-type rotary compressor. Moreover, the present embodiment has been described of the rotary compressor as one example; however, for example, the present embodiment may be applied to a compressor, such as a scroll compressor, using another compression method, and the same effect as that described in the present embodiment, is obtained.

REFERENCE SIGNS LIST

1 rotary compressor
10 compressor main body container
10*c* bottom shell
11 motor
12 compression section
25 accumulator container
26 accumulator shell
26*a* opening side (upper end portion)
26*b* main shell
26*c* bottom shell
28 partition member
35 thermal insulation section
35*a* interior portion space
36 thermal insulation member
37 through hole
39 notch portion
104 suction pipe
107 discharge pipe
V first weld portion
W second weld portion
X third weld portion (weld portion)
Y fourth weld portion
Z fifth weld portion

The invention claimed is:

1. A hermetic type compressor comprising:

a compressor main body container that is a vertical type having a cylindrical shape and that is provided with a discharge pipe and a suction pipe for a refrigerant;

an accumulator container that is connected to the suction pipe;

a compression section that is arranged inside the compressor main body container, that compresses the refrigerant, which has been sucked from the accumulator container by way of the suction pipe, and that discharges the compressed refrigerant from the discharge pipe; and a motor that is arranged inside the compressor main body container and that drives the compression section, wherein the accumulator container includes an accumulator shell having a cup shape, and a weld portion in which an opening side of the accumulator shell is bonded to the compressor main body container, a partition member, which partitions an interior portion of the accumulator shell, is provided in the interior portion, a thermal insulation section, which blocks a heat transfer from the compressor main body container to the accumulator container, is formed between the partition member and a bottom shell, which is included in the compressor main body container, the thermal insulation section, when viewed from a vertical direction of the compressor main body container, is formed on a plane along a radial direction of the bottom shell to overlap across a projection region on which the bottom shell is projected, and a thermal insulation member comprising a structure is provided to fill in an entirety of an interior portion space in the thermal insulation section.

2. The hermetic type compressor according to claim 1, wherein the accumulator shell is provided with a through hole to connect the interior portion space to an outside of the accumulator shell, the through hole is a notch portion formed in a part of a circumferential direction of an end portion of the opening side of the accumulator shell, and the weld portion is provided along a circumferential direction of the opening side except for the notch portion.

3. The hermetic type compressor according to claim 1, wherein the accumulator shell includes a main shell that has a cylindrical shape, and a bottom shell that is bonded so as to block a lower end portion of the main shell, the bottom shell of the accumulator shell has an outer circumferential surface bonded to an inner circumferential surface of the lower end portion of the main shell, the partition member has an outer circumferential surface bonded to an inner circumferential surface of the main shell between an upper end portion and the lower end portion of the main shell, and the upper end portion of the main shell of the accumulator shell has an inner circumferential surface bonded to an outer circumferential surface of the bottom shell of the compressor main body container.

4. The hermetic type compressor according to claim 3, wherein a through hole is arranged in a lower part of the interior portion space provided in the thermal insulation section.

5. A hermetic type compressor comprising:

a compressor main body container that is a vertical type having a cylindrical shape and that is provided with a discharge pipe and a suction pipe for a refrigerant;

an accumulator container that is connected to the suction pipe;

a compression section that is arranged inside the compressor main body container, that compresses the refrigerant, which has been sucked from the accumulator container by way of the suction pipe, and that discharges the compressed refrigerant from the discharge pipe; and a motor that is arranged inside the compressor main body container and that drives the compression section, wherein the accumulator container includes an accumulator shell having a cup shape, and a weld portion in which an opening side of the accumulator shell is bonded to the compressor main body container, a partition member, which partitions an interior portion of the accumulator shell, is provided in the interior portion, a thermal insulation section, which blocks a heat transfer from the compressor main body container to the accumulator container, is formed between the partition member and a bottom shell, which is included in the compressor main body container, a thermal insulation member is provided in the thermal insulation section, the accumulator shell is provided with a through hole to connect an interior portion space of the thermal insulation section to an outside of the accumulator shell, the through hole being a notch portion formed in a part of a circumferential direction of an end portion of the opening side of the accumulator shell, and the weld portion is provided along the circumferential direction of the opening side except for the notch portion.

* * * * *